US005907523A

United States Patent [19]

Richins

[11] Patent Number: 5,907,523

[45] Date of Patent: May 25, 1999

[54] MULTI-TIME-ZONE TIMEPIECE DISPLAY

[76] Inventor: Jay Richins, 520 E. Spruce, Caldwell, Id. 83605

[21] Appl. No.: 08/944,944

[22] Filed: Oct. 2, 1997

Related U.S. Application Data

[63] Continuation of application No. 08/547,735, Oct. 26, 1995, abandoned.

[51] Int. Cl.[6] ..... G04B 19/22

[52] U.S. Cl. ..... 368/21

[58] Field of Search ..... 368/21–27

[56] References Cited

U.S. PATENT DOCUMENTS

| | | | |
|---|---|---|---|
| 1,046,246 | 12/1912 | Albrecht | 368/21 |
| 2,271,539 | 2/1942 | Bryce | 368/21 |
| 3,186,158 | 6/1965 | Miller | 58/42.5 |
| 3,379,004 | 4/1968 | Lee | 58/42.5 |
| 3,503,203 | 3/1970 | Mutter et al. . | |
| 3,653,204 | 4/1972 | Miwa | 58/42.5 |
| 3,763,645 | 10/1973 | Kim | 58/43 |
| 4,179,877 | 12/1979 | Wilson et al. | 58/56 |
| 4,204,398 | 5/1980 | Lemelson | 58/47 |
| 4,972,392 | 11/1990 | Wang | 368/21 |
| 5,008,866 | 4/1991 | Thinesen | 368/21 |
| 5,107,468 | 4/1992 | Lu | 368/27 |
| 5,339,293 | 8/1994 | Kamiyama et al. | 368/21 |

FOREIGN PATENT DOCUMENTS

| | | | |
|---|---|---|---|
| 525569 | 8/1940 | United Kingdom | 368/21 |

*Primary Examiner*—Bernard Roskoski

*Attorney, Agent, or Firm*—Ken J. Pedersen; Barbara S. Pedersen

[57] ABSTRACT

A timepiece which simultaneously displays the time in several different time zones is disclosed. The timepiece may have a single clock unit, with several separate time displays being controlled by the single clock unit, in which case, the different times displayed in the different time zones result from a central display offset means. Or, the timepiece may have multiple clock units, the multiple units each having their own display, and being coordinated or set to display the time in the different time zones. In this case, the coordination or setting of the multiple clock units may be done by hand or automatically. Associated with each time display is a label to indicate the time zone or a location within the time zone for that display. Preferably, the labels are changeable so that the time zone or location indicated may be changed.

3 Claims, 3 Drawing Sheets

38

MULTI-TIME-ZONE TIMEPIECE DISPLAY

This application is a continuation of my earlier application, Ser. No. 08/547,735, filed Oct. 26, 1995, now abandoned, and also entitled MULTI-TIME-ZONE TIMEPIECE DISPLAY.

BACKGROUND OF THE INVENTION

1. Field of the Invention

This invention relates generally to chronometers and timepieces, and more specifically to a timepiece which simultaneously displays the time in several different time zones.

2. Description of Related Art

Often it is convenient or necessary to know the time of day in several locations in different time zones. For example, an over-the-road trucker may want to know, without making mental calculations, the time at the company's headquarters in New York City, at the warehouse in Chicago, at the destination in Los Angeles, and at home in Denver. Likewise, a marketing executive in Tampa may want to know the time at the importer's office in Seattle, of one supplier's factory in Taipei, and at another supplier's factory in Moscow.

Therefore, there is a need for a timepiece which simultaneously displays the time in several different time zones. Also, there is a need for such a timepiece in which the different time zones are selectable.

U.S. Pat. No. 3,763,645 (Kim) discloses a rotary clock with a twelve-sectored dial attached to the same shaft as the hour hand. Stickers provided with the names of cities in other time zones may be placed on the respective sectors of the dial to indicate the time in the respective cities.

Likewise, U.S. Pat. Nos. 4,972,392 (Wang) and 5,107,468 (Lu) both disclose rotary clock faces which are adapted to display the time in several different time zones.

Still, there is a need for a timepiece which simultaneously displays the time in several different time zones, the time zones being specifically labeled so that no mental calculations are needed to determine the time in a time zone of interest.

This invention addresses this need.

SUMMARY OF THE INVENTION

The invention is a timepiece which simultaneously displays the time in several different time zones. The timepiece may have a single clock unit, with several different time displays being controlled by the single clock unit. In this case, the different times displayed in the different time zones result from a central display offset means. Preferably, the offset in the time zones is adjustable so that the different time zones are selectable.

Alternatively, the timepiece may have multiple clock units, the multiple units each having their own display, and being coordinated to display the time in the different time zones. In this case, the coordination of the multiple clock units may be done by hand or automatically.

Associated with each separate time display is a label or other indicia to indicate the time zone or a location within the time zone for that display. Preferably, the labels are changeable so that different time zones or locations may be indicated.

The invention provides a versatile display in a compact, single unit, which shows a plurality of time zones and preferably provides a means for sounding an alarm at a set time corresponding to any selected time zone.

DESCRIPTION OF THE PREFERRED EMBODIMENTS

Figure 1:
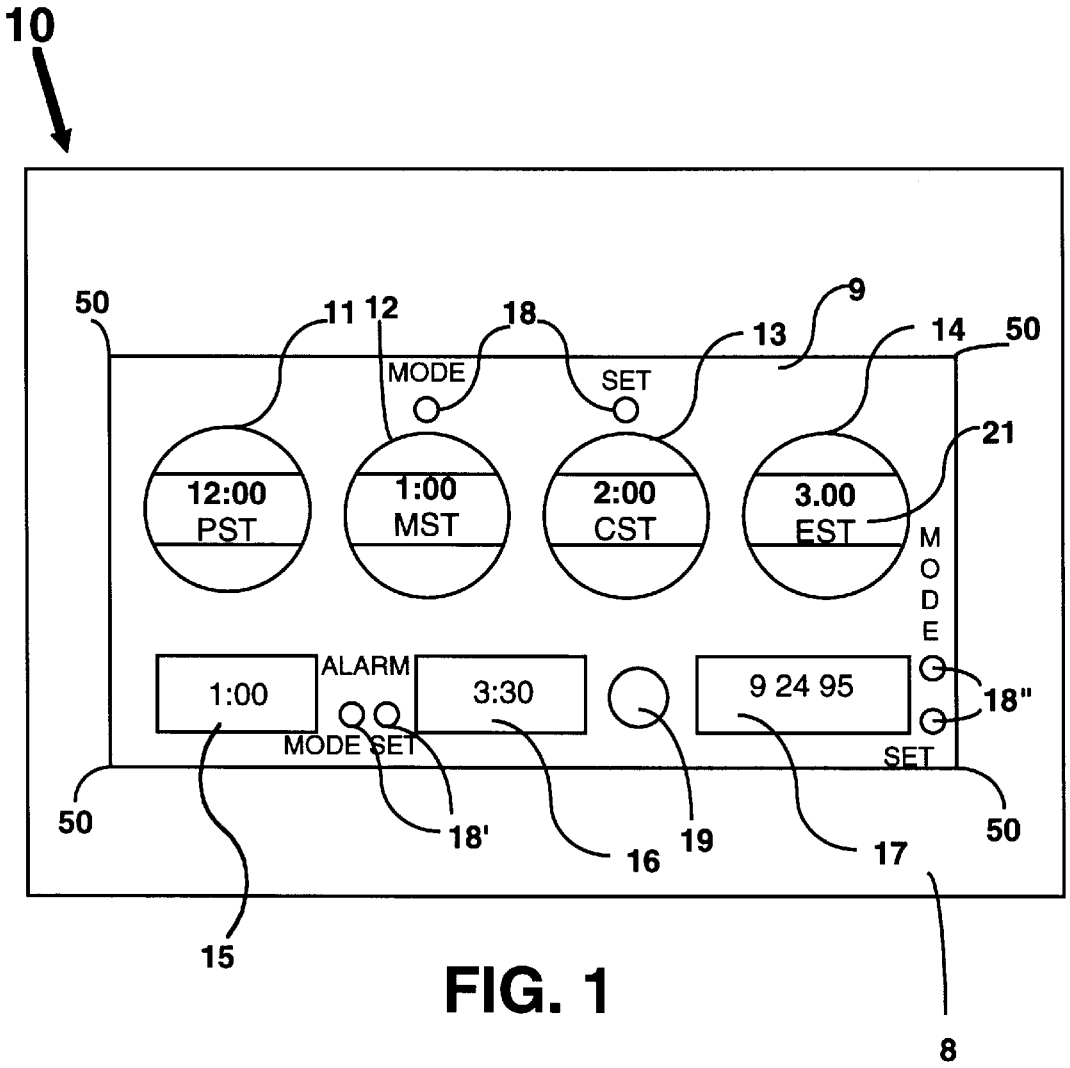
FIG. 1 is a front view of one embodiment of the invention for mounting, for example, on or in the dashboard of a vehicle.

Referring to FIG. 1, there is depicted an embodiment 10 of the timepiece invention, a dashboard unit for mounting, for example, on or in the dashboard 8 of a vehicle. Dashboard unit 10 comprises a housing 9 holding four time displays 11, 12, 13, and 14 with, in this case, digital displays. Also, associated with time displays 11–14 are labels, in this case, "PST" (for Pacific Standard Time), "MST" (for Mountain Standard Time), "CST" (for Central Standard Time), and "EST" (for Eastern Standard Time). In addition, dashboard unit 10 has optional select-time display 15, alarm-set time display 16, and date display 17. Also, mode selection and set button sets 18, 18' and 18" may also be provided to assist in operation and control of the different displays. Other optional features, like, for example, buzzer/alarm speaker or indicator light 19, may be provided. As shown in FIG. 1, housing 9 may be rectangular and have four corners 50, with the select-time display 15 being located near one of the corners.

Select-time display 15 may be set to correspond to any particular desired time zone, either the user's local time zone or a time zone of particular interest for some other reason. The alarm system may be set relative to the time of the select-time display 15 so that a buzzer or other alarm sounds at a set time in the selected time zone. For example, as shown in FIG. 1, the user may select Mountain Standard Time as a time zone of particular interest, because he/she may need to conference call or attend a meeting with someone in that time zone. The user sets the select-time display 15 to match the time in the MST zone, and sets the alarm system so that the alarm-set time display 16 shows the time of the conference call or meeting and so that the alarm sounds at that time. The select-time display 15 may be set to correspond to a time shown by one of the displays 11–14 or an entirely different time.

Alternatively, the wiring and/or programming of the unit 10 may be designed so that the alarm-set time display 16 may cooperate and communicate with one of the time displays 11–14 instead of with the optional select-time display 15. In other words, the alarm may be set to sound at a set time in one of the time zones being clocked and displayed by one of the time displays 11–14.

Dashboard unit 10 may be manufactured from conventional materials and components by conventional techniques. The time and date displays are preferably LED type displays. Dashboard unit 10 may have a single or multiple clock units (not shown). By "clock unit" I mean any device, whether electrical, electronic or mechanical, which marks time, and is capable of sending a signal representing the marked time to the time displays. Many types of such clock units exist, and they are considered conventional.

In the case that a single clock unit controls several time displays, the different times displayed for the different time zones result from a central display offset means (not shown), which controls the differences or intervals between the displays 11–14. The offset may be described by t+x, where t is the reference time, and x may be different offsets for each display 11–14 relative to the reference time. For example, as shown in FIG. 1, time display 11 may be programmed to display time t, time display 12 may be programmed to display time t+1 hour, display 13 to display t+2, and display 14 to display t+3 hours. Thus, the interval between the displays 11–14 is adjustable by changing the "x" in "t+x hours" to any number, preferably between 1–23, to display times in time zones separated by one hour or more than one hour. Alternatively, other offset methods may be used, for example, where display 11 is $t_1$, display 12 is $t_2=t_1+x$ hours, display 13 is $t_3=t_2+y$ hours, and display 14 is $t_4=t_3+z$ hours, with x, y, and z being adjustable. The central display offset means may be a conventional feature of electrical or electronic circuit design.

In the case that dashboard unit 10 has multiple clock units, each unit may have its own dedicated display. Or, alternately, the multiple clock units may each control several time displays. In these cases, the multiple-time displays resulting from the multiple clock units need to be coordinated to correctly display the time in the different time zones. This coordination may be done by hand or automatically, the automatic version being a feature of conventional electric or electronic design.

Associated with time displays 11–14 are labels for indicating the time zone or a location within the time zone. For example, display 14 has a label 21 "EST" (for Eastern Standard Time), but could alternatively be labeled "New York City" or "Headquarters". Preferably, the labels are changeable so that the time zone or location indicated in it may be changed when the display 11–14 is set to a different time. This adjustment may be made by hand, as in penciling a different set of indicia on a removable or replaceable adhesive tag or marking a wipeable or erasable surface, for example. Or, this adjustment may be a conventional feature built into the electric or electronic circuitry of a separate LED display.

Figure 2:
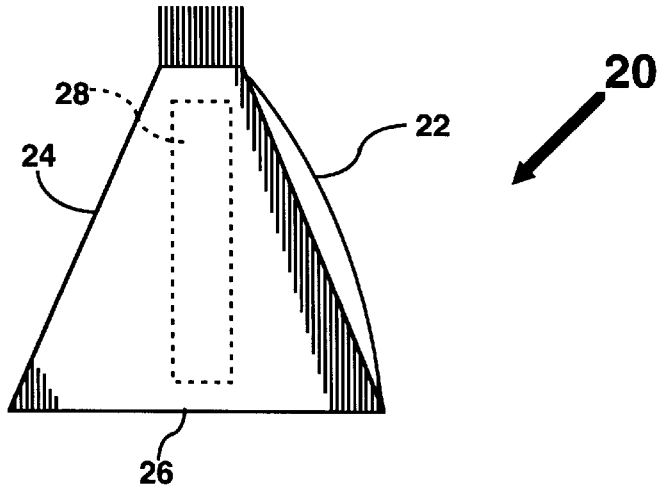
FIG. 2 is a side view of another embodiment of the invention for placing, for example, on a desk or countertop.

Referring to FIG. 2, there is depicted another embodiment 20 of the invention, a desktop unit, for placing on a desk or countertop. Desk top unit 20 may be made of materials and components similar to those used for dashboard unit 10, as discussed above. Likewise, the mechanical linkage, or electrical or electronic circuit design, for desktop unit 20 is similar to those used for dashboard unit 10.

The face side 22 of the disk top unit 20 may include a plurality of time displays, labels, a select-time display, an alarm-set time display, date display, alarm light or buzzer, and control buttons or switches, etc., as described for the dashboard unit 10. The back 24 may provide a slanted surface or nameplate on which a person's name or other indicia is engraved or printed, so that the unit 20 becomes a stylish accessory when placed on its base 26 on a desk or bank teller station, for example. The clock unit 28 or units may be enclosed and hidden inside the housing of the unit 20 to create an attractive design.

Figure 3:
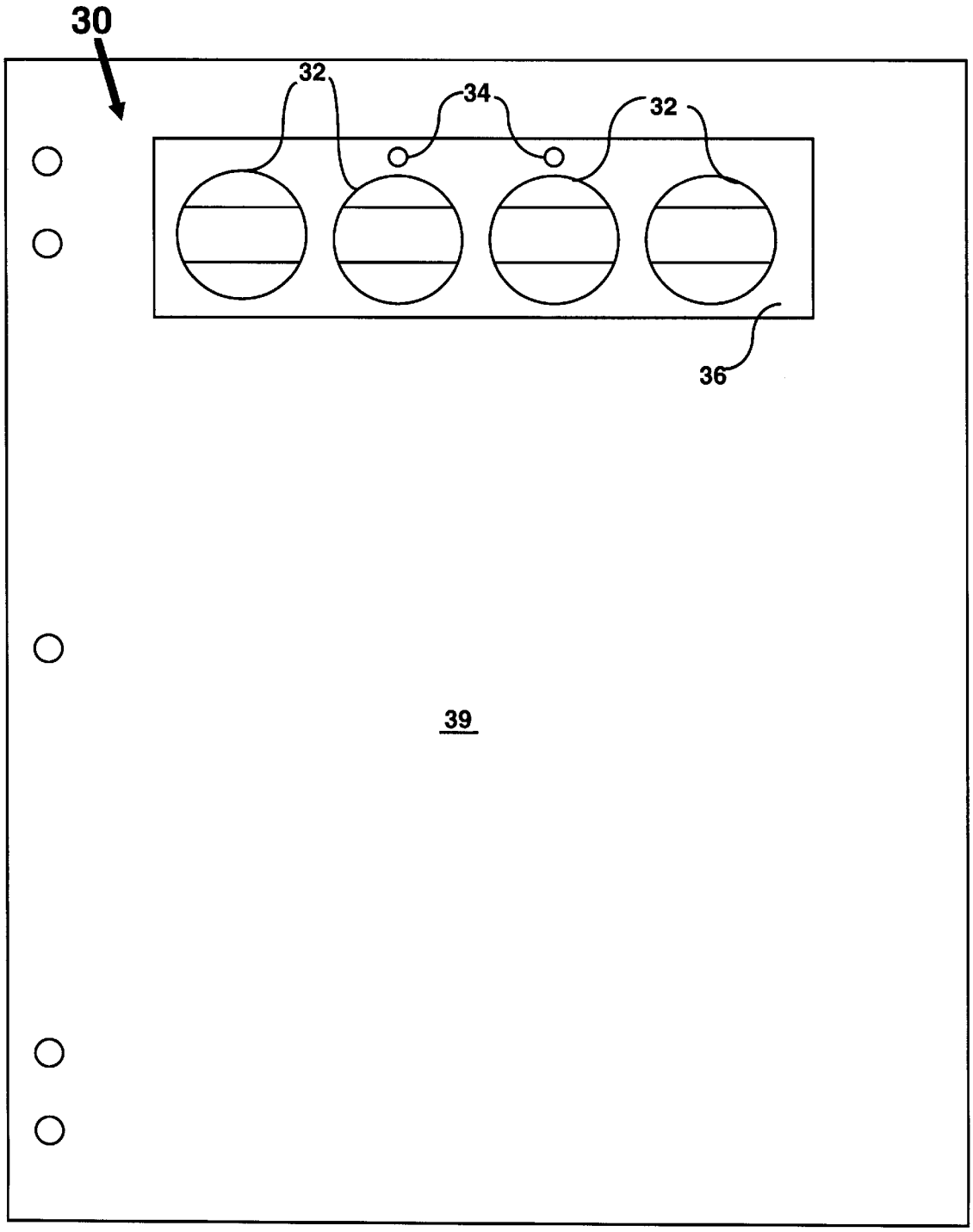
FIG. 3 is a front view of another embodiment of the invention mounted, for example, in a notebook.

Referring to FIG. 3, there is depicted another embodiment 30 of the invention, a notebook unit. The construction and design of notebook unit 30 is similar to that of dashboard unit 10 and desktop unit 20, except that it is installed in a notebook or binder. The time displays 32 and controls 34 may be on a thin panel 36 attached to a sturdy notebook page 38, for example, leaving a portion 39 of the page surface for maps, notes, clippings, schedule tables, etc. The page 38 could be a plastic with an erasable or wipeable portion 39 for notes or map route markings.

Figure 4A:
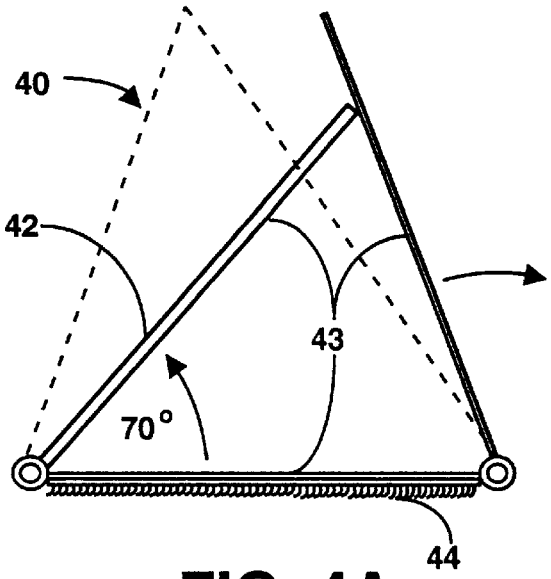
FIGS. 4A, 4B, and 4C are side views of another foldable, portable embodiment of the invention for placing, for example, on a hotel room desk.
Figure 4B:
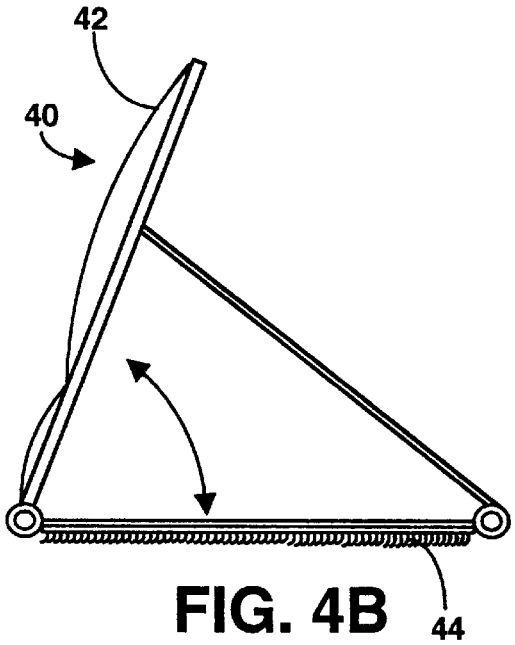
Figure 4C:
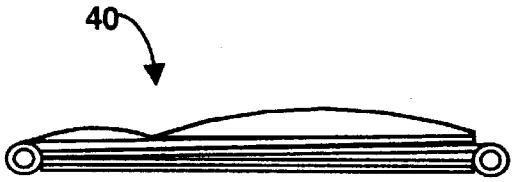

Referring to FIGS. 4A, 4B, and 4C, there is depicted another foldable, portable embodiment 40 of the invention. This embodiment is constructed similarly to a popular folding alarm clock, with a foldable case 43 as the housing for the timepiece. The clock face 42 position is adjustable to various positions, as shown in FIGS. 4A–4C.

In operation, power, for example, mechanical, as in a spring winding, or AC or DC electricity, is supplied to the timepiece. Then, the original settings are made in the time and date displays, and the intervals between the times displayed are established. Likewise, alarm setting, if any, is made. Thereafter, the times in the different time zones of interest may be determined by simply observing the different time displays.

The dashboard unit 10, portable unit 40, or other embodiments may be attached to surfaces by various means, for example, strips of hook-and-loop fastener 44. With a detachable design, the invention may be carried with the user, moved from truck to truck, or carried in a briefcase, for example. Also, for example, the time displays may be lighted for night driving use.

Although this invention has been described above with reference to particular means, materials and embodiments, it is to be understood that the invention is not limited to these disclosed particulars, but extends instead to all equivalents within the scope of the following claims.

I claim:

1. A multi-time-zone timepiece comprising:

a single clock unit;

a plurality of digital time displays which receive a signal from the clock unit, said time displaying different times for different time zones;

an adjustable time display offset means which controls the intervals between the different times displayed by said time displays;

a select-time display displaying a time the same as a selected one of said plurality of digital time displays, the select-time display showing simultaneously with but separate from said selected one of the plurality of digital time displays:

means for sounding an alarm at an alarm-set time corresponding to the time of one of said digital time displays:

an alarm-set time display displaying the alarm-set time simultaneously with, but separately from, the plurality of digital time displays and the select-time display; and a changeable label associated with each digital time display.

2. The timepiece of claim 1 which is portable.

3. A multi-time-zone timepiece comprising:

a single clock unit;

a plurality of digital time displays which receive a signal from the clock unit, said time displaying different times for different time zones;

an adjustable time display offset means which controls the intervals between the different times displayed by said time displays;

a select-time display displaying a time the same as a selected one of said plurality of digital time displays, the select-time display showing simultaneously with but separate from said selected one of the plurality of digital time displays;

means for sounding an alarm at an alarm-set time corresponding to the time of one of said digital time displays;

an alarm-set time display displaying the alarm-set time simultaneously with, but separately from, the plurality of digital time displays and the select-time display;

a changeable label associated with each digital time display; and a generally rectangular housing holding said clock unit, plurality of digital time displays, offset means, select-time display, means for sounding an alarm, alarm-set time display, and changeable labels, said housing being adapted for removable attachment to a vehicle dashboard and said housing having four comers;

wherein the select-time display is located near one of the comers.

* * * * *